US010253938B2

(12) United States Patent
Spinger et al.

(10) Patent No.: US 10,253,938 B2
(45) Date of Patent: Apr. 9, 2019

(54) LIGHTING ARRANGEMENT WITH EXACT POSITIONING OF AN OPTICAL ELEMENT

(71) Applicant: Lumileds Holding B.V., Schiphol (NL)

(72) Inventors: Benno Spinger, Aachen (DE); Josef Schug, Aachen (DE); Robert Derix, Aachen (DE)

(73) Assignee: Lumileds Holding B.V., Schiphol (NL)

( * ) Notice: Subject to any disclaimer, the term of this patent is extended or adjusted under 35 U.S.C. 154(b) by 0 days.

(21) Appl. No.: 16/068,601

(22) PCT Filed: Jan. 5, 2017

(86) PCT No.: PCT/EP2017/050205
§ 371 (c)(1),
(2) Date: Jul. 6, 2018

(87) PCT Pub. No.: WO2017/121676
PCT Pub. Date: Jul. 20, 2017

(65) Prior Publication Data

US 2019/0011101 A1 Jan. 10, 2019

(30) Foreign Application Priority Data

Jan. 12, 2016 (EP) ..... 16150880

(51) Int. Cl.
*F21V 29/00* (2015.01)
*F21S 41/19* (2018.01)
(Continued)

(52) U.S. Cl.
CPC ..... *F21S 41/19* (2018.01); *F21S 41/147* (2018.01); *F21S 41/321* (2018.01); *F21S 45/47* (2018.01);
(Continued)

(58) Field of Classification Search
CPC ..... F21S 41/143; F21S 41/147; F21S 41/19
See application file for complete search history.

(56) References Cited

U.S. PATENT DOCUMENTS

2007/0133220 A1 6/2007 Watanabe et al.
2013/0120988 A1* 5/2013 Woodward ..... F21V 13/04 362/235
(Continued)

FOREIGN PATENT DOCUMENTS

DE 202012104066 U1 1/2013
DE 102015208487 A1 11/2015
(Continued)

*Primary Examiner* — Andrew J Coughlin
(74) *Attorney, Agent, or Firm* — Volpe and Koenig, P.C.

(57) ABSTRACT

A lighting arrangement 10 is described with an LED element 30. A reference frame part 14 comprises a frame opening 26 bordered by frame edges 28*a*, 28*b*, 28*c*, 28*d*. The LED element 30 is arranged such that light is emitted through the frame opening 26 and is partially shielded at least at a first frame edge 28*b*. The reference frame part further comprises reference portions 20*a*, 20*b*, 20*c*, 20*d* to define positions relative to the frame 5 opening. A first reference portion 20*a*, 20*b* is provided on a first surface portion of the reference frame part 14 arranged parallel to a light emitting surface 38 of the LED element 30. A second reference portion 20*c* is arranged on a second surface portion of the reference frame part 14 arranged perpendicular to the first surface portion. A third reference portion 20*d* is arranged on a third surface portion of the reference frame part 14 arranged 10 perpendicular to both the first and second surface portions. An optical element 12 for shaping an illumination beam 42 from light emitted from the LED element 30 through the frame opening 26 is arranged to be in contact with the reference frame part 14 at the first, second and third reference portions 20*a*, 20*b*, 20*c*, 20*d* to define a position of the optical element relative to the frame opening 26.

12 Claims, 3 Drawing Sheets

(51) Int. Cl.

| | |
|---|---|
| ***F21S 41/147*** | (2018.01) |
| ***F21S 45/47*** | (2018.01) |
| ***F21V 29/503*** | (2015.01) |
| ***F21S 41/32*** | (2018.01) |
| *F21Y 115/10* | (2016.01) |

(52) U.S. Cl.
CPC ..... *F21V 29/503* (2015.01); *F21Y 2115/10* (2016.08)

(56) References Cited

U.S. PATENT DOCUMENTS

| | | | | |
|---|---|---|---|---|
| 2016/0312978 | A1* | 10/2016 | Park | F21V 7/0033 |
| 2018/0283644 | A1* | 10/2018 | Mertens | F21V 19/045 |

FOREIGN PATENT DOCUMENTS

| | | | |
|---|---|---|---|
| EP | 2428725 | A2 | 3/2012 |
| EP | 2846078 | A1 | 3/2015 |
| JP | 2008-204903 | A | 9/2008 |
| WO | 2006/097067 | A1 | 9/2006 |
| WO | 2012/011947 | A1 | 1/2012 |
| WO | 2014/028955 | A1 | 2/2014 |
| WO | 2014/185511 | A1 | 11/2014 |

* cited by examiner

LIGHTING ARRANGEMENT WITH EXACT POSITIONING OF AN OPTICAL ELEMENT

FIELD OF THE INVENTION

The invention relates to a lighting arrangement. In particular, the invention relates to a lighting arrangement including at least one LED element, which may be used e.g. in vehicle lighting, in particular automotive front lighting.

BACKGROUND OF THE INVENTION

In particular in automotive lighting, LED lighting elements are used more and more due to the inherent advantages such as long lifetime, energy efficiency, and small size.

In particular for automotive front lighting, the illumination beam emitted from the lighting arrangement must follow tight specifications. This requires exact positioning of the elements of the lighting arrangement relative to each other.

WO2006/082537A1 describes a light-source module with at least one light-emitting element, in particular for use in headlights of motor vehicles. In one embodiment, an LED module has a substantially cuboid carrier. A light exit area is rectangular in shape. At least one edge of the area can be used to produce a light-dark boundary in the light emission pattern of the optical system. A light source, such as an LED, a collimator aperture or the end of a light guide is situated in a rectangular opening in a side-face of the module. A lens element of the same shape as the opening is preferably placed over the light source. On a first side-face three reference points are arranged by which a cuboid carrier rests against a corresponding mating surface belonging to an optical system. On a second side surface two second reference points are arranged. The module is aligned or positioned relative to a reference plane of the optical system by way of the reference points.

US 2007/0133220 A1 discloses a vehicle lighting device with a lamp compartment having a light source unit disposed therein. The light source unit includes a light emitting device as a light source and a projection lens as a light distribution control member for distributing light. A face bearing portion at a distal end of a lens mounting portion of the light emitting device corresponds to a rear surface of a collar portion disposed along an outer circumference of the projection lens.

EP 2 428 725 A2 describes an optical unit comprising a heat sink that radiates heat from a light source and a base portion including a reflector mounting section, a lens mounting section and a connecting section connecting the reflector mounting section and the lens mounting section. The base portion is configured such that the light from the light source is reflected by a reflector mounted onto the reflector mounting section and is incident onto a projection lens mounted onto the lens mounting section. The heat sink is exposed to a space surrounded by the lens mounting section, the connecting section and the reflector mounting section.

SUMMARY OF THE INVENTION

It may be considered an object to propose a lighting arrangement which facilitates exact positioning of an optical element relative to an LED element.

The object is achieved by a lighting arrangement according to claim 1. Dependent claims refer to preferred embodiments of the invention.

The present inventors have considered that the position of the actual light emitting surface of an LED element is defined by the LED chip position. If the LED chip is arranged on a carrier, such as a board, a positioning tolerance of the chip on the carrier may be an important factor in the tolerance chain. To overcome this, the present inventors propose a lighting arrangement with a reference frame part which comprises reference portions for exact positioning of an optical element and a frame opening through which light from the LED element may be emitted.

The lighting arrangement according to the invention comprises at least one LED element. The term "LED element" is used here to refer to any type of single solid state lighting element or group of solid state lighting elements, such as light emitting diodes, laser diodes, organic light emitting diodes (OLED) and the like. The LED element has a light emitting surface which may preferably be a plane surface. The light emitting surface may preferably be of rectangular shape.

In order to shape an illumination beam from light emitted from the LED element, an optical element is provided. The term "optical element" here refers to any type of element that may shape or alter the emitted light beam, such as in particular a collimator, reflector, lens, etc.

A reference frame part is provided which comprises a frame opening and reference portions to define positions relative to the frame opening.

The LED element may be arranged within or behind the frame opening, such that light emitted from the LED element is emitted through the frame opening. At least one frame edge, which is here referred to as a first frame edge, is arranged to shield a portion of the light emitted from the LED element. Thus, at least the first frame edge is optically active, i.e. serves to shape the beam emitted through the frame opening. In preferred embodiments, more than one frame edge may shield light emitted from the LED element.

By using a frame opening bordered by one or more frame edges which partially shield light emitted from the LED element, the actual positioning of the LED element, e.g. on its carrier, relative to the respective frame edge, no longer contributes to the tolerance chain. The optical system, and in particular the optical element, may be referenced relative to the frame opening, and in particular relative to the first frame edge rather than to the actual position of the LED element.

Referencing of the optical element is achieved by providing reference portions on the reference frame part, including at least a first reference portion on a first surface portion of the reference frame part which is arranged parallel to the light emitting surface (Z-reference), a second reference portion on a second surface portion of the reference frame part arranged perpendicular to the first surface portion (X-reference), and a third reference portion (Y-reference) on a third surface portion of the reference frame part arranged perpendicular to both the first and second surface portions. Thus, the reference frame part provides reference portions for arrangement of the optical element in the direction of three axes, e.g. the Z-axis perpendicular to the light emitting surface and X- and Y-axes parallel to the light emitting surface. Each of the reference portions provided on the respective surfaces may be of any shape suited to be contacted by a corresponding part of the optical element. While, as will become apparent in connection with preferred embodiments, the reference portions may preferably be provided with protrusions out of the respective surface portions, it is also possible to provide reference portions as flat parts of the surface portion, or as holes or indentations.

The optical element is arranged to be in contact with the reference frame part at least at the first, second and third reference portions to define its position relative to the frame opening. In this way, very narrow tolerances may be achieved, because the reference portions and the frame edges, in particular the first frame edge, are arranged on the same element. Preferably, the reference frame part may be provided such that at least the first frame edge and the first, second and third reference portions are provided as a single body instead of being assembled from several parts. It is especially preferred to provide the reference frame part entirely in one piece. For example, the reference frame part may be made out of plastic, e.g. by injection molding. Alternatively, the reference frame part may be made out of other materials, such as ceramics, metal, or metal embedded in plastic.

By use of the reference frame part, which preferably is provided between the LED element and the optical element, it is thus possible to achieve very exact positioning of the optical element relative to the light of the LED element as it is emitted through the frame opening and partially shielded at least at the first frame edge. Positioning of the optical element, e.g. a reflector, may be achieved in the direction of all three axes.

According to a preferred embodiment of the invention, the depth or thickness of the frame opening is relatively small. It is preferred that the frame edges have a thickness (measured in the main light emission direction, i.e. perpendicular to the light emitting surface) which is less than the width of the frame opening. The width of the frame opening may be measured e.g. as the distance between opposite frame edges. For a rectangular frame there may be a large width (measured between the short edges) and a small width (measured between the long edges). It is preferred that the depth or thickness of the frame edge is less than even the smallest width of the frame opening. Particularly preferred is a thickness of less than half of the smallest width of the frame opening.

Preferably, the inner surfaces of the frame edges extend straight into the main light emission direction, i.e. are arranged perpendicular to the light emitting surface, or arranged inclined inwards, such that the frame opening toward the optical element is smaller than the distance between the lower frame edges between which the light from the LED element enters. Thus, it is preferred that the frame edges are not inclined outwards. A straight or inwards inclined arrangement of at least one, preferably all frame edges may serve to achieve a certain shielding at the edges and obtain a well-defined light emitting area.

Further, it is preferred that the frame edges have a non-specular inner surface. In this way, the frame edges may be better suited to shield portions of the emitted light and thus border an effective light emission area without introducing reflections. Further preferred, the surface of the frame edges may be white, i.e. have a reflectivity of more than 90%.

According to the invention, the LED element is arranged relative to the frame edges such that the light emitting surface, as viewed from the main light emission direction, extends at least up to all frame edges. It is also possible that a light emitting surface of the LED element may extend a certain (preferably small) distance beyond the frame edges, i.e. the light emitting surface may be partially covered by at least one frame edge if viewed from the main light emission direction. While a certain portion of the light is then lost by shading and the total luminous flux is reduced, this ensures that the frame opening may be entirely illuminated, such that its frame edges constitute the exact borders of the effective light emitting surface.

While other types of optical elements may be provided, the optical element in contact with the reference frame part preferably is a reflector. In particular, a dome-shaped reflector is preferred. As will become apparent in connection with preferred embodiments, the reflective surface of the reflector preferably covers the main light emission direction of the LED lighting element, such that the optical axis of the illumination beam emitting from the reflector is arranged at an angle to the original main light emission direction of the LED element.

In preferred embodiments of the invention, a heat sink may be arranged in thermal contact with the LED element. Any body of a shape and material which may dissipate heat generated by the LED element may be used as a heat sink. Preferably, the heat sink is made out of metal, particularly of good heat conduction, such as e.g. copper or aluminum. Further, it is preferred that the heat sink comprises heat dissipation structures such as fins or other protrusions achieving an enlarged surface. Preferably, the reference frame part may be arranged between the heat sink and the optical element.

At least one spring element may be provided to apply a force to press the optical element against at least one of the reference portions. One or more spring elements may urge the optical element toward the reference frame part in all three axes directions X, Y and Z. In particular, it is preferred to arrange a spring for applying a force between the optical element and the heat sink, thus sandwiching the reference frame part in between.

According to one preferred embodiment, the reference frame part may comprise a raised portion. The raised portion may be arranged raised above the frame opening in the main light emission direction, i.e. perpendicular to the light emitting surface. As will become apparent in connection with preferred embodiments, it is particularly preferred to provide a raised portion with an upper surface that is inclined in a direction away from the frame opening, i.e. the height of which (in the main light emission direction) increases with increasing traverse distance from the frame opening, so that shading of light by the raised portion is minimized or avoided.

Preferably, the reference frame part may comprise a cutout to receive a carrier, e.g. a printed circuit board (PCB), on which the LED element is provided. It is particularly preferred to provide a cutout within a raised portion such that sufficient space for electrical components may be provided.

BRIEF DESCRIPTION OF THE DRAWINGS

The above and other features and advantages of the present invention will become apparent from the following description of preferred embodiments, in which.

Figure 6:
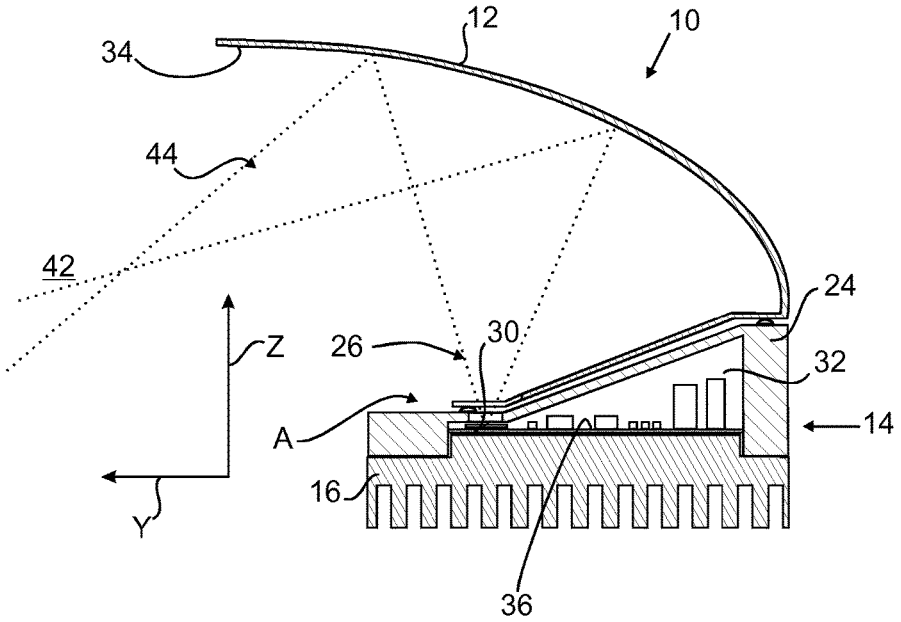
FIG. 6 shows a sectional view of the lighting arrangement of FIG. 1.

FIG. **6*a* shows an enlarged view of the portion A in FIG. 6**.

DETAILED DESCRIPTION OF EMBODIMENTS

Figure 1:
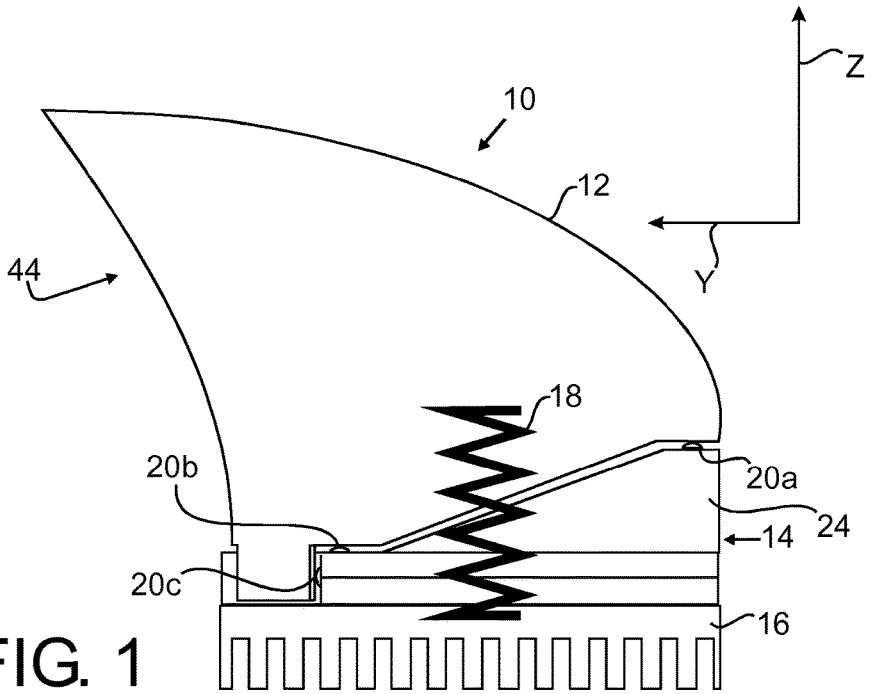
FIG. 1 shows a side view of an embodiment of a lighting arrangement.
Figure 2:
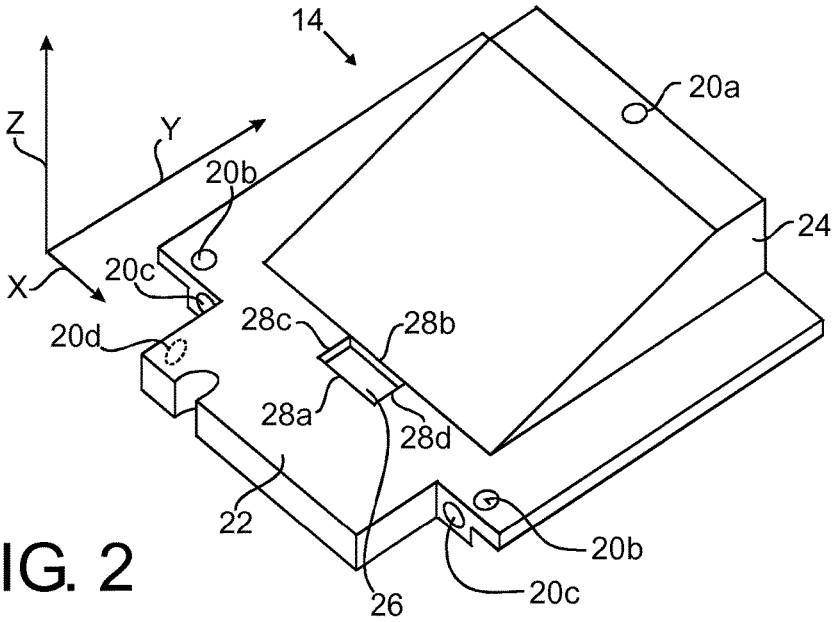
FIG. 2 shows a perspective view of a reference frame part of the lighting arrangement of FIG. 1.
Figure 3:
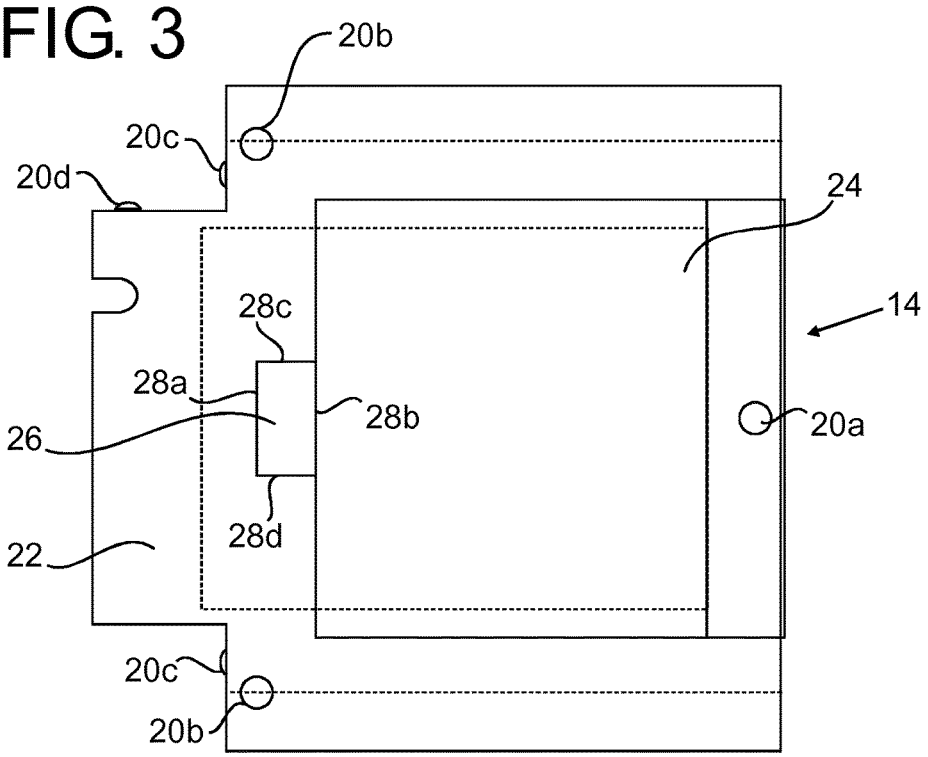
FIG. 3-5 show a top view, a front view and a side view of the reference frame part of FIG. 2.
Figure 4:
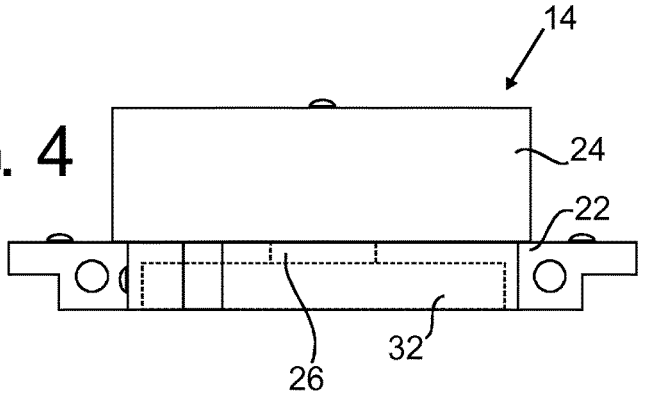
Figure 5:
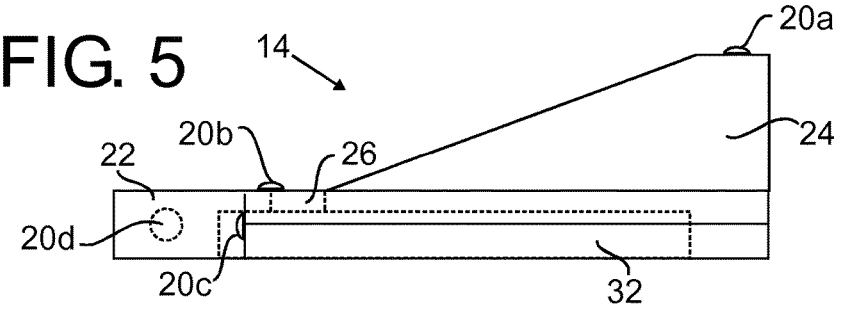

FIG. 1 shows a side view of an LED lighting module (lighting arrangement) 10, comprising as optical element a dome-shaped reflector 12. The lighting arrangement 10 further comprises a reference frame part 14 and a heat sink 16. The reference frame part 14 is provided sandwiched between the reflector 12 and the heat sink 16. A spring 18 (symbolically shown) urges the reflector 12 toward the heat sink 16, in the example shown in the direction of a Z-axis.

As shown in FIG. 1, the reflector 12 is in direct mechanical contact with reference portions 20*a*, 20*b*, 20*c* provided on the reference frame part 14.

FIGS. 2-5 show the reference frame part 14, which in the embodiment shown is generally comprised of plate-shaped main body 22 and a raised portion 24 extending above the plane of the plate-shaped main body 22 in the direction of the Z-axis. The reference frame part 14 is provided as a single body of plastic. It comprises an inner cutout 32, open to the lower side.

The reference frame part 14 comprises a frame opening 26 of rectangular shape bordered by frame edges 28*a*, 28*b*, 28*c*, 28*d*. Two shorter frame edges 28*c*, 28*d* and two longer frame edges 28*a*, 28*b* are arranged opposite each other.

Provided on surfaces of the reference frame part 14 are reference portions 20*a*, 20*b*, 20*c*, 20*d*. In the example shown, the reference portions are slight rounded protrusions provided on the respective surfaces. As explained, the reference portions serve for positioning of the reflector 12. Thus, in alternative embodiments (not shown), reference portions may be of different shape, e.g. raised protrusions of other shape than shown in the examples, or holes, indentations, cutouts, or plane surfaces of the reference frame part 14, suited to be brought into abutting contact with corresponding parts of reflector 12.

The protrusions 20*a*, 20*b* are provided on the upper surface of the main plate body 22 and on an upper, straight surface portion of the inclined portion 24. The respective surfaces are arranged perpendicular to the Z-axis. Thus, the reference portions 20*a*, 20*b* serve as a reference for the exact positioning of the reflector 12 in the direction of the Z-axis.

Reference portions 20*c* are provided on an edge surface of the main plate body 22 as shown in FIG. 2-5. The edge surface on which they are provided is arranged perpendicular to the Y-axis, thus parallel to the X- and Z-axes. The reference portions 20*c* may thus serve for positioning the reflector 12 with respect to the Y-axis.

Reference portion 20*d* is arranged on a further edge surface of the main plate body 22, which is perpendicular to the X-axis and parallel to the Z- and Y-axes. The reference portion 20*d* may thus serve for positioning of the reflector 12 with respect to the X-axis.

FIG. 6 shows the lighting arrangement 10 in a cross sectional view. The dome-shaped reflector 12 is hollow and has an inner reflector surface 34. Arranged within the cutout 32 of the reference frame part 14 is a printed circuit board 36. Arranged on the printed circuit board 36 is an LED chip 30, as also visible from the enlarged view of FIG. 6*a*. Further electrical components for operating the LED chip 30 are provided on the printed circuit board 36 within the hollow raised portion 24 of the reference frame part 14.

The printed circuit board 36 is arranged on the heat sink 16, so that the electrical components and in particular the LED chip 30 is in thermal contact and heat can be dissipated.

As in particular visible from the enlarged view of FIG. 6*a*, the LED chip 30 is arranged below the frame opening 26 such that light from an upper light emitting surface 38 in a main light emitting direction L is emitted through the frame opening 26.

The inner surfaces 40 of the frame edges 28*a*, 28*b*, 28*c*, 28*d* are straight and in parallel to the main light emission direction L, perpendicular to the light emitting surface 38.

The thickness d of the frame opening, i.e. the extension in the direction L, is relatively small compared to the width w. In the view of FIG. 6*a*, the smallest width w between the long frame edges 28*a*, 28*b* of the rectangular frame opening 26 is shown. The thickness d is less than half of the smallest width w.

Figure 6A:
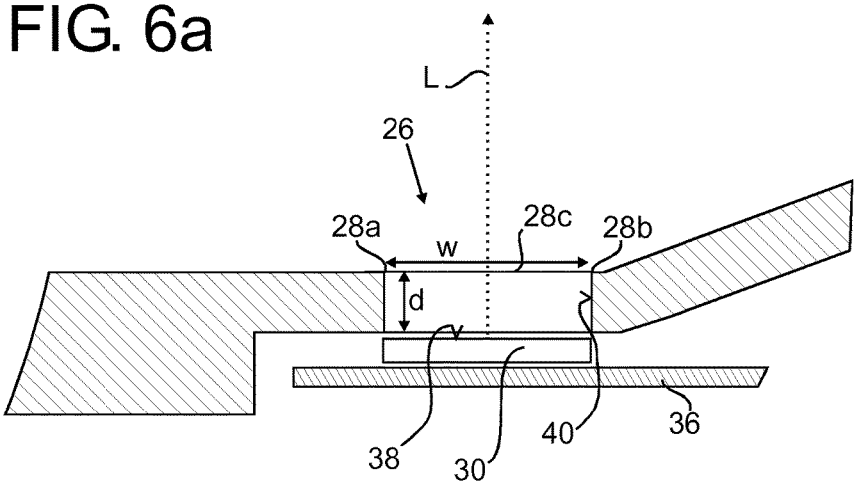

As visible from FIG. 6*a*, the LED chip 30 extends, as viewed from the direction L, right up to the frame edges 28*a*, 28*b*. Due to the nature of the light emitting surface 38 as a Lambertian emitter, the frame edges 28*a*, 28*b* thus shield a certain portion of the light emitted from the light emitting surface 38. In traverse direction (not shown), the LED chip 30 also extends up to the short frame edges 28*c*, 28*d*, which thus also shield a portion of the emitted light. Since thus the light emitting surface 38 of the LED chip 30 completely fills the frame opening 26, this opening may be regarded as effective light emitting area, irrespective of the exact positioning of the LED chip 30 on the printed circuit board 36 or with respect to the reference frame part 14.

While use of the frame opening 26 as an effective light emitting area allows for a certain amount of tolerance between the positioning of the LED chip 30 and the reference frame part 14, it is still preferred to achieve good accuracy in the relative arrangement. Thus, it may be preferable to arrange and to fix the reference frame part 14 such that the frame edges 28*a*, 28*b*, 28*c*, 28*d* are very close to the borders of the light emitting surface 38. During production, the relative arrangement may be achieved by a separate alignment step. The LED chip 30, the printed circuit board 36, and the reference frame part 14 may be held in the aligned position relative to each other by a rigid connection, e.g. by welding, glueing, overmoulding, etc.

In order to account for an increased amount of tolerance in the relative arrangement, it may be considered (not shown in the drawings) to provide an LED chip 30 with a light emitting surface 38 which is slightly larger than the width w of the frame opening 26. Thus, one or more of the frame edges 28*a*, 28*b*, 28*c*, 28*d* may cover, as viewed from the perpendicular direction L, a certain portion of the light emitting area 38; i.e. the light emitting area 38 may extend beyond one or more of the frame edges below the frame opening 26. For the purposes of the design of the remaining components of the optical system, the frame opening 26 may be considered as effective light emitting area, instead of the actual light emitting surface 38 of the LED chip 30.

In operation of the lighting arrangement 10, light from the light emitting surface 38 of the LED chip 30 is emitted through the frame opening 26 into the interior of the reflector 12. The emitted light is partially shielded at the edges 28*a*, 28*b*, 28*c*, 28*d*. The raised portion 24 of the reference frame part 14, however, is arranged under an inclination angle such that no portion of the light emitted through the frame opening 26 is further shielded.

As shown in FIG. 6, the light emitted from the LED chip 30 is reflected at the reflective inner surface 34 of the reflector 12 to form an illumination beam 42 which is emitted from a reflector opening 44. A dome-shaped reflector 12 is arranged such that the illumination beam 42 is entirely composed of beams reflected at the reflective surface 34 with no direct light from the LED chip 30. If the LED module 10 is used for automotive front lighting, the illumination beam 42 comprises an intensity distribution according to the respective regulation, which may, for example, include a bright/dark cutoff. The intensity distribution of the illumination beam 42 is achieved by the shape of the reflective surface 34 of the reflector 12 (which in the drawings is shown only symbolically). In particular, a bright/dark cutoff in the intensity distribution of the illumination beam 42 may be achieved by a reflection of one of the edges of the frame opening 26, for example of the long edge 28*b*.

The reflector 12 is positioned with reference to the reference frame part 14 with respect to all three axes X, Y, and Z. In direction of the Z-axis, the reflector 12 is pressed against the reference portions 20*a*, 20*b* on top surfaces of the reference frame part 14. For positioning in the direction of the Y-axis, a tab of the reflector 12 is pressed against the reference portions 20*c* on a first edge surface of the reference frame part 14. With respect to the X-axis, a further tab at the reflector 12 is pressed against the reference portion 20*d* provided on a second edge surface of the reference frame part 14.

Since the reference portions 20*a*, 20*b*, 20*c*, 20*d* are provided in one part together with the frame edges 28*a*, 28*b*, 28*c*, 28*d*, the positioning of the reflector 12 relative to the frame opening 26 acting as effective light emitting area may be provided with very small tolerance.

While the invention has been illustrated and described in detail in the drawings and foregoing description, such illustration and description are to be considered illustrative or exemplary and not restrictive; the invention is not limited to the disclosed embodiments.

For example, the lighting arrangement and further optical system may comprise further or other optical elements besides or instead of the reflector 12, e.g. reflectors of other type and shape, lenses etc.

Other variations to the disclosed embodiments can be understood and effected by those skilled in the art in practicing the claimed invention, from a study of the drawings the disclosure, and the appended claims.

In the claims, the word "comprising" does not exclude other elements or steps, and the indefinite article "a" or "an" does not exclude a plurality. The mere fact that certain measures are recited in mutual different dependent claims does not indicate that a combination of these measures cannot be used to advantage. Any reference signs in the claims should not be construed as limiting the scope.

The invention claimed is:

1. A vehicle lighting arrangement comprising at least one LED element with a light emitting surface, a reference frame part comprising a frame opening of rectangular shape bordered by frame edges, the LED element being arranged such that light from the light emitting surface is emitted through the frame opening and is partially shielded at least by a first frame edge, the light emitting surface of the LED element extends at least up to the frame edges to ensure that the frame opening is entirely illuminated, such that the frame edges constitute the exact borders of an effective light emitting surface of the LED element, the reference frame part further comprising reference portions to define positions relative to the frame opening, the reference portions including at least a first reference portion on a first surface portion of the reference frame part arranged parallel to the light emitting surface, a second reference portion on a second surface portion of the reference frame part arranged perpendicular to the first surface portion, and a third reference portion on a third surface portion of the reference frame part arranged perpendicular to both the first and second surface portions, and an optical element for shaping an illumination beam from light emitted from the LED element through the frame opening, the optical element being arranged to be in contact with the reference frame part at the first, second and third reference portions to define a position of the optical element relative to the frame opening.

2. The vehicle lighting arrangement according to claim 1, wherein the frame edges having a thickness in a direction perpendicular to the light emitting surface, the thickness being less than a width of the frame opening.

3. The vehicle lighting arrangement according to claim 1, wherein the frame edges have an inner surface arranged perpendicular to the light emitting surface, or that the inner surface is arranged inclined inwards.

4. The vehicle lighting arrangement according to claim 1, wherein the frame edges have a non-specular inner surface.

5. The vehicle lighting arrangement according to claim 1, wherein the optical element is a reflector.

6. The vehicle lighting arrangement according to claim 5, wherein the reflector is dome-shaped.

7. The vehicle lighting arrangement according to claim 1, wherein a heat sink is arranged in thermal contact with the LED element, the reference frame part being arranged between the heat sink and the optical element.

8. The vehicle lighting arrangement according to claim 7, wherein a spring element is provided for applying a force to press the optical element against at least one of the reference portions.

9. The vehicle lighting arrangement according to claim 8, wherein the spring is arranged to apply the force between the optical element and the heat sink.

10. The vehicle lighting arrangement according to claim 1, wherein the reference frame part comprises a raised portion which is arranged raised above the frame opening in a direction perpendicular to the light emitting surface.

11. The vehicle lighting Lighting-arrangement according to claim 10, wherein the raised portion comprises an upper surface being inclined in a direction away from the frame opening.

12. The vehicle lighting arrangement according to claim 1, wherein the reference frame part comprises a cutout to receive a carrier on which the LED element is provided.

* * * * *